US005448033A

United States Patent [19]

Leone et al.

[11] Patent Number: 5,448,033

[45] Date of Patent: Sep. 5, 1995

[54] CIRCUIT BREAKER STATIONARY CONTACT STRAP

[75] Inventors: David A. Leone, Lilburn, Ga.; Donald M. Boles, Hillsdale, N.J.

[73] Assignee: Siemens Energy & Automation, Inc., Alpharetta, Ga.

[21] Appl. No.: 356,801

[22] Filed: Dec. 15, 1994

[51] Int. Cl.[6] ..... H01H 1/06; H01H 33/02

[52] U.S. Cl. ..... 218/146; 335/195; 335/196

[58] Field of Search ..... 200/275, 279; 218/16–21, 30–33, 40, 146, 148; 335/16, 195, 196

[56] References Cited

U.S. PATENT DOCUMENTS 4,086,460 4/1978 Gillette ..... 218/21
4,467,301 8/1984 Goodrich ..... 335/195
4,513,267 4/1985 McClellan et al. ..... 335/16
4,950,853 8/1990 Crookston ..... 218/146

*Primary Examiner*—J. R. Scott
*Attorney, Agent, or Firm*—Peter A. Luccarelli, Jr.

[57] ABSTRACT

A stationary contact strap for a circuit breaker, with an electrically conductive body portion having a plurality of discrete apertures arrayed in a pattern which define at least two input portions for splitting transient current input into the contact strap into generally parallel pathways which are also in the same general direction as transient current flow in the circuit breaker movable contact arm; and an output portion electrically coupled to the input portions and the fixed stationary main contact, wherein the output portion is oriented so that transient current flow therethrough is in a direction generally opposite to transient current flow in the movable arm.

20 Claims, 4 Drawing Sheets

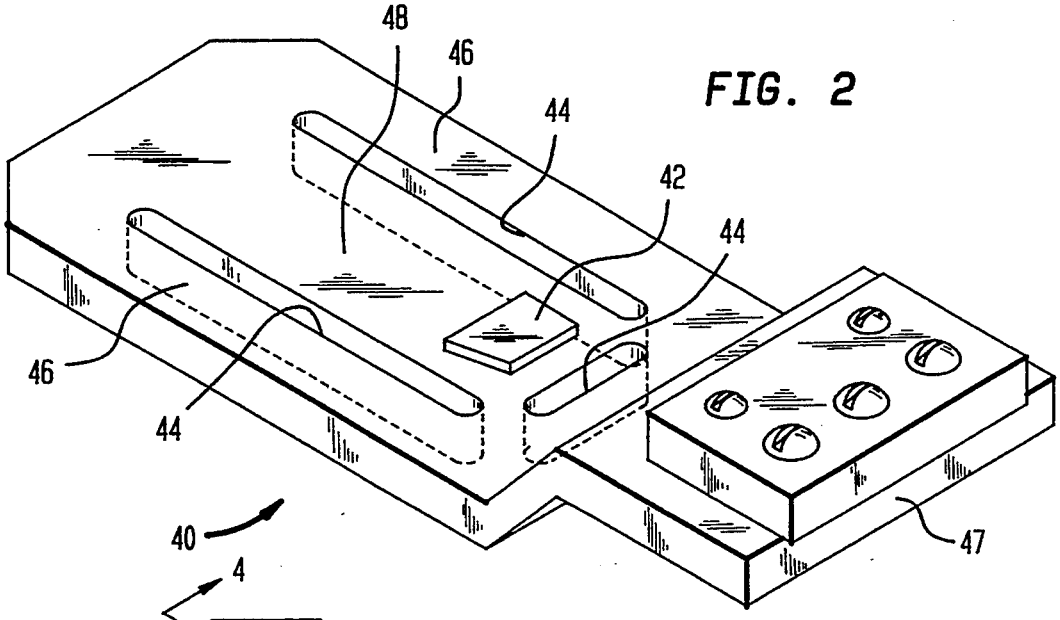
FIG. 2
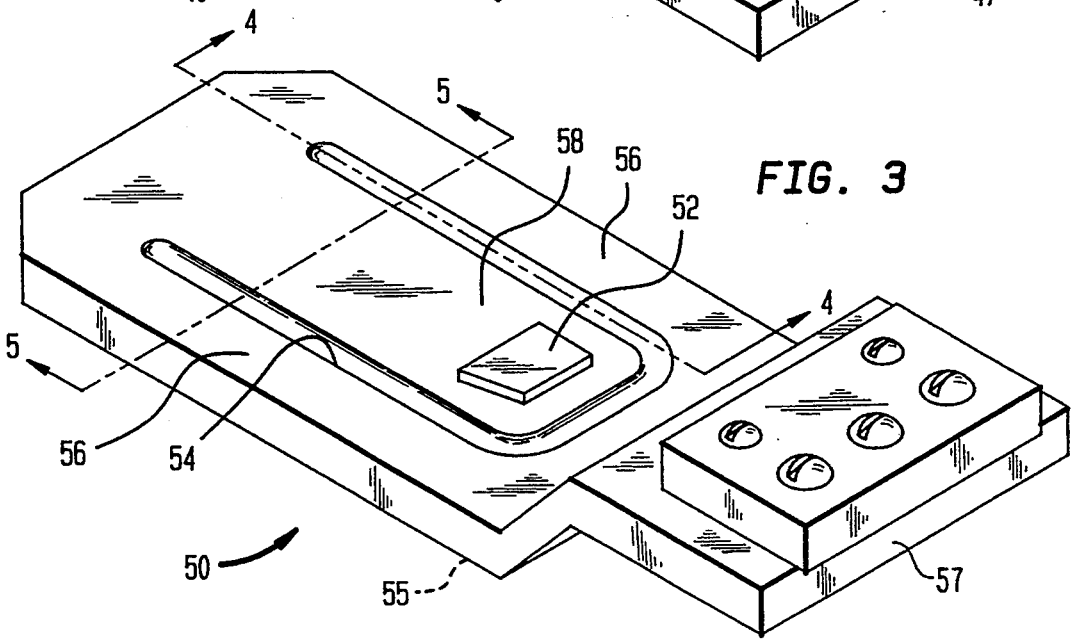
FIG. 3
FIG. 4
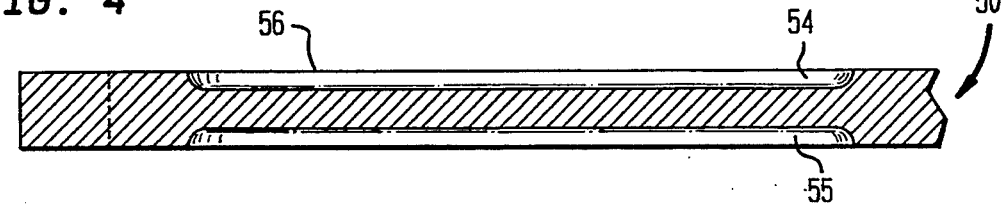
FIG. 5
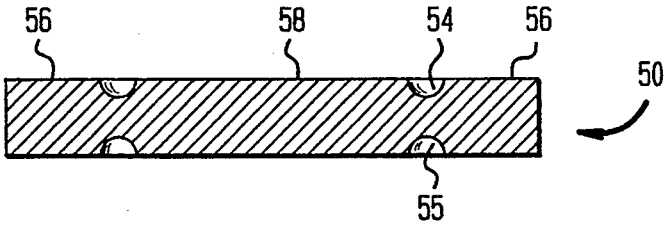

CIRCUIT BREAKER STATIONARY CONTACT STRAP

BACKGROUND OF THE INVENTION

The present invention is directed to stationary contact straps for circuit breakers, and in particular for molded case circuit breakers.

Molded case circuit breakers (hereafter sometimes referred to as "MCCBs") are utilized as circuit protection devices to interrupt current flow in an electric power line upon detection of conditions which do not fall within predefined parameters. For example, if a short circuit occurs within a power line, current flow can increase dramatically above that which is expected during normal operating conditions. The MCCB has an electrically insulative housing which contains at least one stationary and one moving main contact. During normal operational conditions, the main contacts are in a closed, abutting relationship which allows current flow continuity between the contacts and through the power line. When the main contacts separate, current flow is interrupted. Such interruption may occur when the MCCB trip unit which monitors power in the power line detects an operating condition which is not within predefined operational parameters. Alternatively, a user may selectively interrupt power in the power line by manually opening the main contacts by way of an external operating mechanism. General construction and operation of a molded case circuit breaker is set forth in U.S. Pat. No. 4,513,267 ("the '267 patent"), the entire contents of which is hereby incorporated herein by reference as if it were fully set forth herein. The '267 patent is owned by the assignee of the present invention, Siemens Energy & Automation, Inc.

As shown and described in U.S. Pat. No. 4,513,267, the stationary contact is connected to a stationary contact strap in order to provide electrical continuity between a power line and the contact. In order to increase the speed in which the MCCB main contacts separate, and thus decrease the amount of power which passes through the circuit breaker after initiation of disruption, the '267 patent describes an claims a stationary contact strap which splits input current flow among first and second exterior arms defined by the strap, which are outboard an interior arm that is connected to the exterior arms. The arms are defined in a contact strap by a generally U-shaped slot formed in the strap by a punching, milling or other known material removing operation. Current does now flow in the slot, because there is no current-carrying material. In this manner, current flow through the interior arm is channeled in a direction opposite to current flow in the moveable contact arm, so as to create a repulsive "blow off" effect during transient current surges. The same concept is embodied in the stationary contact line strap shown in U.S. Pat. No. 4,950,853 ("the '853 patent").

While the stationary contact strap of the '267 patent provides excellent blow off characteristics, the u-shaped slot defined in the strap is relatively difficult to form by metal punching techniques, due to its large size, and tends to wear out tooling quicker than would otherwise be desirable. It would also be desirable to have a greater cross-sectional area available for reduced steady state current flow density in the stationary contact strap than is possible with the design of the '267 patent, while maintaining the blow off characteristics possible with that earlier design.

It is an object of the present invention to create a stationary contact strap with increased steady state current flow cross section for lower current densities and greater heat transfer capabilities than known stationary contact straps, yet which provides repulsive blow off during overcurrent conditions in the manner of those known designs.

It is an object of the present invention to create a stationary contact strap which is easier to form than known stationary contact straps, yet which provides repulsive blow off during overcurrent conditions in the manner of those known designs.

SUMMARY OF THE INVENTION

The present invention features a stationary contact strap with increased steady state current flow cross section for lower current densities and greater heat transfer capabilities than known stationary contact straps, yet it provides repulsive blow off during overcurrent conditions in the manner of those known designs.

The present invention features a stationary contact strap which is easier to form than known stationary contact straps.

The present invention is directed to a circuit breaker of the type having a housing, an operating mechanism and at least one pair of separable, electrically conductive main contacts, including a fixed stationary main contact coupled to a contact strap and a movable main contact coupled to an electrically conductive movable contact arm. The contact strap has an electrically conductive body portion having a plurality of discrete apertures arrayed in a pattern which define: at least two input portions for splitting transient current input into the contact strap into generally parallel pathways which are also in the same general direction of transient current flow in the movable contact arm; and an output portion electrically coupled to the input portions and the fixed stationary main contact, wherein the output portion is oriented so that transient current flow therethrough is in a general direction opposite to transient current flow in the movable arm.

The present invention also is directed to a circuit breaker comprising a housing; an operating mechanism in the housing; and at least one pair of separable, electrically conductive main contacts in the housing, including a fixed stationary main contact and a movable main contact. The circuit breaker further has an electrically conductive movable contact arm coupled to the movable main contact; and a contact strap including an electrically conductive body portion having a plurality of discrete apertures arrayed in a pattern which define at least two input portions for splitting transient current input into the contact strap into generally parallel pathways which are also in the same general direction as transient current flow in the movable contact arm; and an output portion electrically coupled to the input portions and the fixed stationary main contact, wherein the output portion is oriented so that transient current flow therethrough is in a general direction opposite to transient current flow in the movable arm.

The present invention is also directed to a circuit breaker having a housing; an operating mechanism in the housing; and at least one pair of separable, electrically conductive main contacts in the housing, including a fixed stationary main contact and a movable main contact. The circuit breaker also has an electrically conductive movable contact arm coupled to the movable main contact; and a contact strap including an electrically conductive body portion having a plurality of discrete apertures arrayed in a pattern. The aperture pattern defines at least two input portions for splitting transient current input into the contact strap into generally parallel pathways which are also in the same general direction as transient current flow in the movable contact arm; and an output portion electrically coupled to both the fixed stationary main contact and the input portions between and inboard thereof, so that transient current flow the output portion is in a general direction opposite to transient current flow in the movable arm.

DESCRIPTION OF THE DRAWINGS

FIG. 2 is a perspective view of one embodiment of the stationary contact strap of the present invention.

FIG. 3 is a perspective view of another embodiment of the stationary contact strap of the present invention.

FIG. 4 is an elevational cross section of the stationary contact of strap of FIG. 3, taken along 4—4 thereof.

FIG. 5 is an elevational cross section of the stationary contact of strap of FIG. 3, taken along 5—5 thereof.

DETAILED DESCRIPTION OF THE EMBODIMENTS

Figure 1:
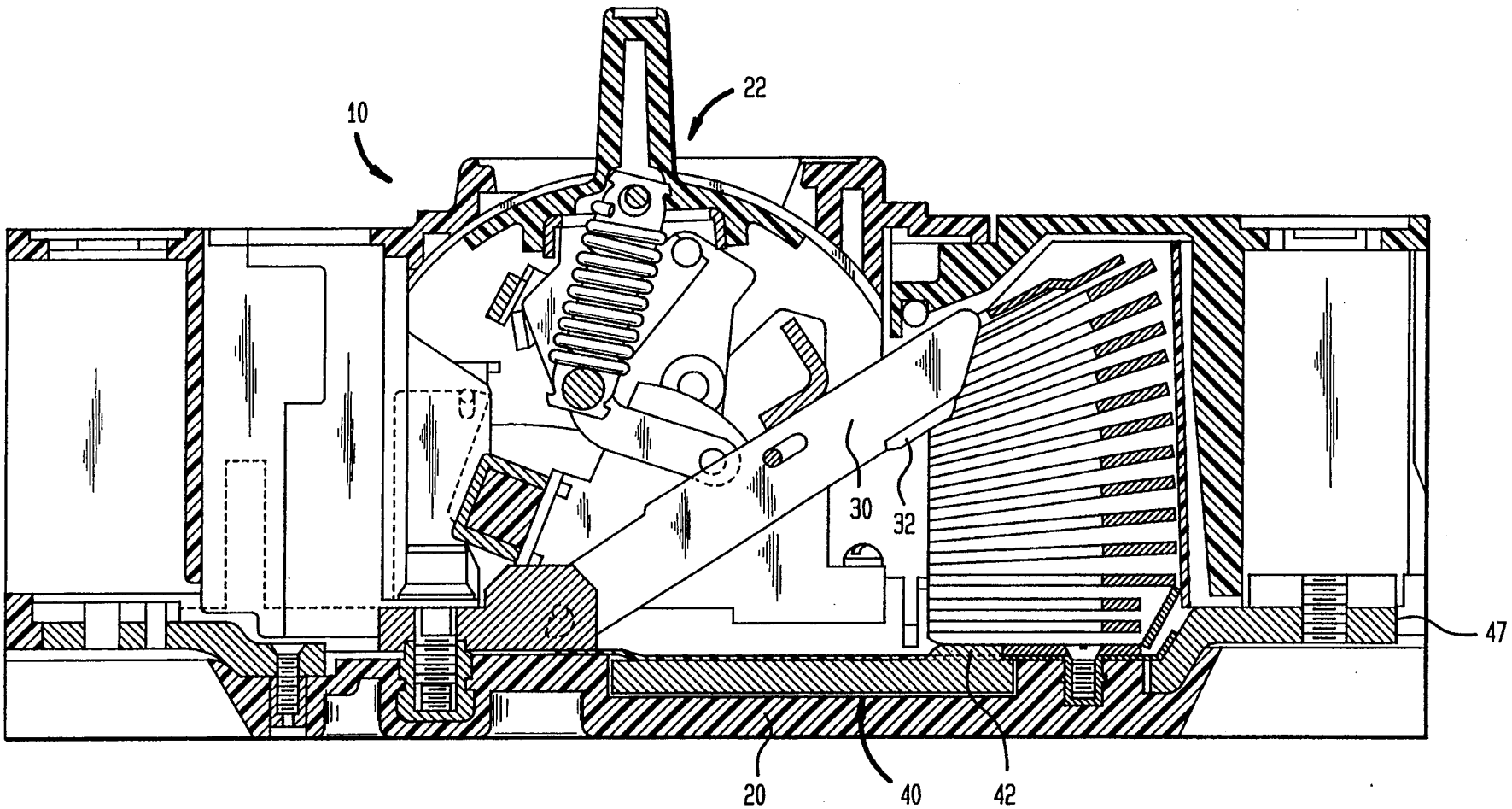
FIG. 1 is an elevational cross section of a molded case circuit breaker having the stationary contact strap of the present invention.
Figure 6:
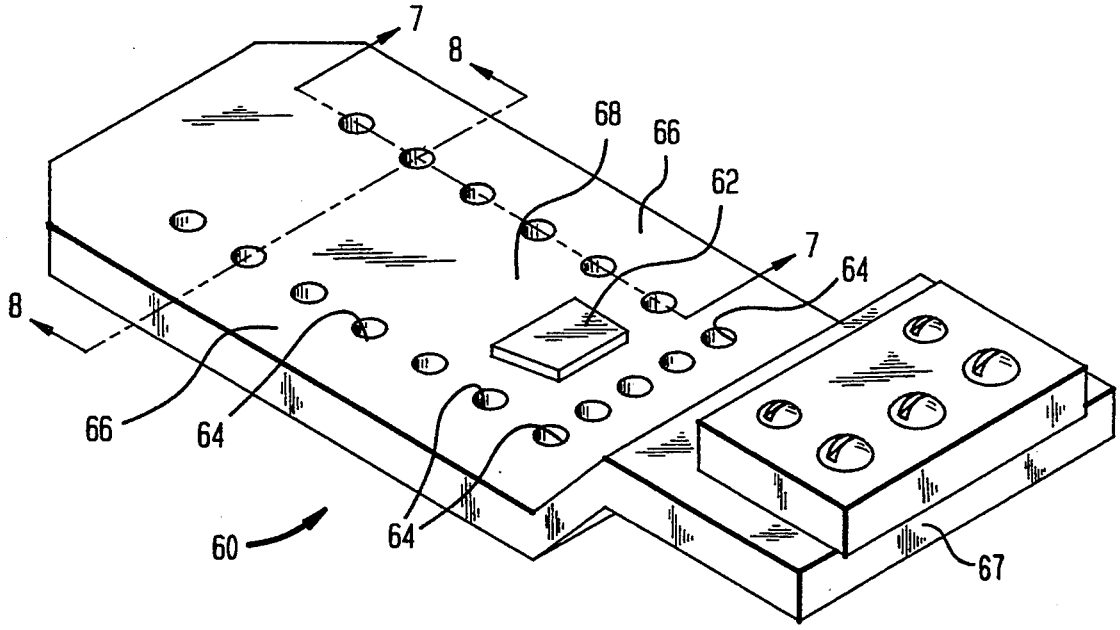
FIG. 6 is a perspective view of another embodiment of the stationary contact strap of the present invention.
Figure 7:
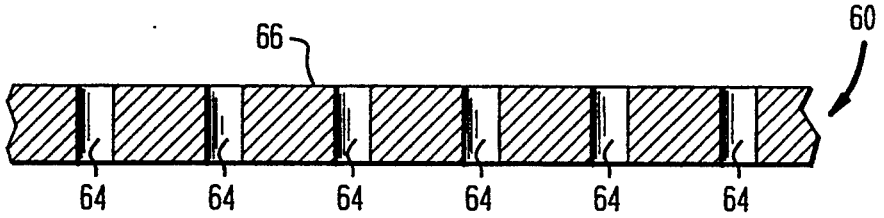
FIG. 7 is an elevational cross section of the stationary contact of strap of FIG. 6, taken along 7—7 thereof.
Figure 8:
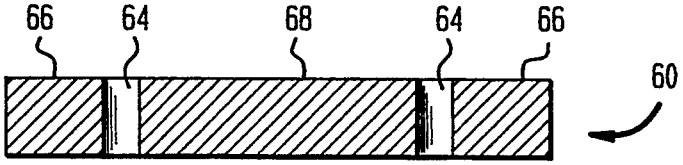
FIG. 8 is an elevational cross section of the stationary contact of strap of FIG. 6, taken along 8—8 thereof.

FIG. 1 shows an elevational cross section of a representative circuit breaker 10 which incorporates the present invention. The circuit breaker 10 is a three phase molded case circuit breaker (MCCB) of the type described in U.S. Pat. No. 4,513,267, the entire contents of which is incorporated by reference as if fully set forth herein.

Generally, circuit breaker 10 has an insulated housing which is formed of a molded plastic. The circuit breaker 10 has an operating mechanism 22 for translating moving contact arm 30, so that moving main contact 32 translates from the so-called "open" position shown in FIG. 1 to a "closed" position proximal stationary contact strap 40 and in abutting, electrically conductive relationship with stationary main contact 42 that is connected to the contact strap 40. When the main contacts 32, 42 are in abutting contact, electric current can pass through the circuit breaker 10, so that for example power can be provided in a circuit from a line source to an electrical load.

Stationary contact strap 40 is shown in more detail in FIG. 2. The contact strap 40 has a body portion formed of a suitable electrically conductive material, such as copper and has the stationary main contact 42 connected thereto. The contact strap 40 has a plurality of discrete apertures 44 which are arrayed in a pattern, which define a pair of outboard current input portions (legs) 46 that split input current from the end 47. The contact strap 40 apertures 44 also define an output portion 48 which is connected to and between the outboard input portions 46.

An alternative embodiment of stationary contact strap 50 of the present invention is shown in FIGS. 3–5. The contact strap 50 has a body portion formed of a suitable electrically conductive material, such as copper and has the stationary main contact 52 connected thereto. The contact strap 50 has a plurality of discrete apertures 54, 55 which comprise grooves formed in the strap by known metal working processes, such as for example EDM or mechanical milling. The aperture grooves 54, 55 reduce strap cross section in which electrical current can be carried transverse the grooves. The aperture grooves 54, 55 are arrayed in a pattern, which define a pair of outboard current input portions (legs) 56 that split input current from the end 57. The contact strap 50 apertures 54 also define an output portion 58 which is connected to and between the outboard input portions 56.

Another embodiment of stationary contact strap 60 of the present invention is shown in FIGS. 6–9. The contact strap 60 has a body portion formed of a suitable electrically conductive material, such as copper and has the stationary main contact 62 connected thereto. The contact strap 60 has a plurality of discrete apertures 64, which comprise holes formed in the strap by known metal working processes, such as for example punching, drilling, EDM or mechanical milling. The apertures 64 reduce strap cross section in which electrical current can be carried transverse the lines of the hole array. The apertures 64 are arrayed in a pattern, which define a pair of outboard current input portions (legs) 66 that split input current from the end 67. The contact strap 60 apertures 64 also define an output portion 68 which is connected to and between the outboard input portions 66.

Figure 9:
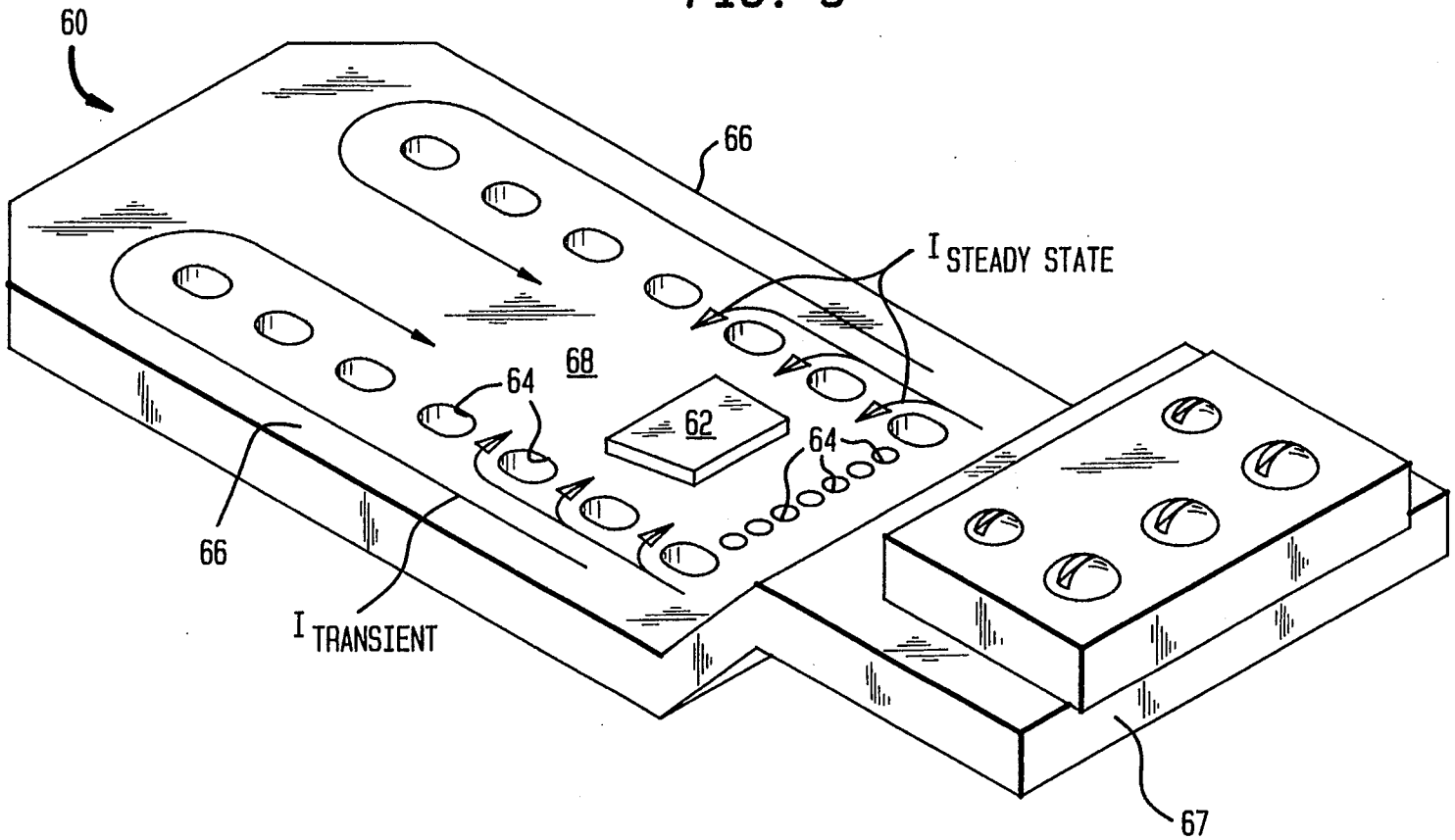
FIG. 9 is a perspective view similar to FIG. 6, showing schematically steady state and transient current flow patterns through the stationary contact strap.

In operation the contact strap 60 conducts current as shown in FIG. 9. While operation of strap 60 is described in detail, the same operational concepts are employed in the straps 40 and 50 of the alternative embodiments. For discussion purposes, it is assumed that the stationary contact strap embodiment 60, with input end 67 and stationary contact 62 is substituted for the embodiment 40 with respective stationary contact 42 and input end 47 shown in FIG. 1. Referring to both FIGS. 1 and 9, while the circuit breaker main contacts 32, 62 are closed, current flows from the line source to the input end 67 and splits through each of the two outboard current input portions (legs) 66. Under steady-state operating conditions, the current $I_{STEADY\ STATE}$ will flow from the legs 66 to the output portion 68 (and ultimately through stationary contact 62) through any conductive path, such as the solid connective material which exists between the array of discrete apertures 64. It is also likely that during steady-state operating conditions, some current will flow all the way through the input leg portions 66 to the output portion 68 and into the stationary main contact 62, as is shown by the flow arrows designated $I_{TRANSIENT}$.

Generally speaking, within stationary contact strap 60, current flows in a generally u-shaped pattern from the input leg portions 66 through the output portion 68 and into the stationary contact 62. As can be understood by reference to FIG. 9, the current flow density is greater in the output portion 68, because it accumulates the combined current flow through the two input portions 66. Current which flows into stationary contact 62 in turn passes through moving contact 32 and through the moving contact arm 30 toward the left in FIG. 1. As described in greater detail in U.S. Pat. No. 4,513,267, current flows from the moving contact arm through a conductive pivot and a so-called load strap, where the power may be accessed for connection to an electrical load.

Focusing on relative current flow direction between the stationary contact strap 60 and the moving contact arm 30, current which enters the input end 67 flows through the input leg portions 66 in a leftwardly direction as shown in FIG. 1, i.e., generally parallel to and in the same direction as current flow through the moving contact arm 30. As can be appreciated from understanding of generally electromagnetic theory, parallel current flows in the same direction through separate spaced conductors create an attractive relative force. Thus, there is an attractive force which tends to draw the outboard, input leg portions 66 toward the moving contact arm 30.

Relative current flow between the contact strap output portion 68 and the moving contact arm 30 is in opposite directions. When evaluated from the relative perspective of FIG. 1, the contact strap output portion 68 current flow is toward the right, whereas the moving contact arm 30 current flow is to the left. Opposite current flows through parallel, separate conductors create a repulsive electromagnetic force. The repulsive force between the moving contact arm 30 and the output portion 68 of stationary contact strap 60 is greater than the attractive forces between the contact arm 30 and the outboard input portions 66, because: (1) the current density is relatively greater in the output portion 68 than the two current splitting input portions 66; and (2) the output portion 68 is closer to the moving contact arm 30 than the input portions 66. Thus, there is a net electromagnetic repulsive force between the stationary contact strap 60 and the moving contact arm 30. The net repulsive force during steady state operating conditions is overcome by an external biasing force, such as a coil spring, which biases the contact arm 30 moving contact 32 into abutting electrical contact with the stationary contact 62.

The stationary contact strap of the present invention better balances transient and steady-state current flow for a given current condition within a circuit breaker application. A design goal is to optimize steady-state and transient current flow characteristics for a given circuit breaker design and current condition. Steady-state current flow, $I_{STEADY\ STATE}$, has been previously described, but a more detailed discussion of transient current flow follows.

During transient current surges within the power system circuit which is protected by the circuit breaker 10, a current inrush, $I_{TRANSIENT}$, will be created within the stationary contact strap 60, as shown in FIG. 9. The transient current will tend to flow through the path of least impedance, which is in a generally u-shaped path all the away around input end input end 67, through the input leg portions 66 and in turn into the output portion 68. This is because electrical impedance is greater along the lines through the array of apertures 64. The inrush current $I_{TRANSIENT}$ creates a so-called "blow off" repulsive force which tends to force the main contacts 32, 62 to separate rapidly. Relatively more rapid contact separation desirably reduces energy which would otherwise have to be dissipated by the circuit breaker 10 and the electrical system as a whole.

Compare the structure of the stationary contact strap embodiments 40, 50, 60 of the present invention with the previously known stationary contact straps of U.S. Pat. Nos. 4,513,267 and 4,950,853. The prior patents show contact straps which separate outboard, current input legs from a centrally located output current leg by way of a single u-shaped cutout stamped therein. All steady state current flow in the known contact straps must follow a current path through the input and output legs, similar to that shown by the $I_{TRANSIENT}$ arrows shown in FIG. 9 with respect to the present invention. This effectively leads to a relatively smaller current-carrying cross section through the known stationary contact straps than that which is accomplished with the contact straps 40, 50, 60 of the present invention. The present invention contact straps 40, 50, 60 allow current flow, especially in steady state, through the connective portions between the discrete arrayed apertures, for example apertures 44, 54, 55 and 64 of the embodiments previously described herein. The larger current carrying cross section of the contact straps 40, 50 and 60 allow for cooler operating temperatures.

Moreover, by virtue of a greater amount of connective material between the arrayed discrete apertures of the stationary contact straps 40, 50 and 60 of the present invention, more heat can be conducted away from the output center leg portions 48, 58 and 68 of the respective embodiments than can be conducted by the corresponding output portions of the contact straps of the known U.S. Pat. Nos. 4,513,267 and 4,950,853.

As one skilled in the art can appreciate, during design of the contact strap of the present invention, the discrete aperture array pattern, shape and size of the apertures affect current flow and heat transfer through the strap. Similarly, aperture size and shape affect ease of manufacture of the contact strap. Generally speaking, a greater number of smaller, discrete apertures (for example, FIG. 6) are easier to form by a metal punching manufacturing operation, and offer greater more dispersed, less concentrated current and heat transfer than a smaller number of larger apertures (for example, FIG. 2). Ultimately, it is up to the designer to optimize such design parameters to suit the intended application.

It is not intended that the specific detailed embodiments shown herein restrict the scope of the invention as set forth in the claims. By way of example, as those skilled in the art can no doubt appreciate, the term "aperture" as used herein means any type of contact strap forming operation which leaves a hole, pit, depression, cavity, indentation, recess, opening, gap, slit or the like which reduce current flow, so as to form separate current channeling input and output portions needed to create "blow off" repulsive force between the stationary contact strap and moving contact arm during transient current surges. Similarly, while the embodiments of the invention shown herein have a pair of input portion legs which are outboard of a central output portion leg, it is possible to configure the topology of the stationary contact strap so that repulsive blow off force is accomplished through other layouts.

What is claimed is:

1. In a circuit breaker of the type having a housing including therein an operating mechanism and at least one pair of separable, electrically conductive main contacts, including a fixed stationary main contact coupled to a contact strap and a movable main contact coupled to an electrically conductive movable contact arm, the contact strap comprising an electrically conductive body portion having a plurality of discrete apertures arrayed in a pattern which define:

at least two input portions for splitting transient current input into the contact strap into generally parallel pathways which are also in the same general direction as transient current flow in the movable contact arm; and an output portion electrically coupled to the input portions and the fixed stationary main contact, wherein the output portion is oriented so that transient current flow therethrough is in a direction generally opposite to transient current flow in the movable arm.

2. The stationary contact strap of claim 1, wherein the array of discrete apertures comprise at least one hole.

3. The stationary contact strap of claim 1, wherein the array of discrete apertures comprise a plurality of holes in a generally u-shaped array.

4. The stationary contact strap of claim 3, wherein the holes are formed by punching the conductive body.

5. The stationary contact strap of claim 1, wherein the array of discrete apertures comprise at least one elongated hole.

6. The stationary contact strap of claim 1, wherein the array of discrete apertures comprise a plurality of elongated holes in a generally u-shaped array.

7. The stationary contact strap of claim 1, wherein the array of discrete apertures comprise grooves.

8. A circuit breaker comprising:

a housing;

an operating mechanism in the housing;

at least one pair of separable, electrically conductive main contacts in the housing, including a fixed stationary main contact and a movable main contact;

an electrically conductive movable contact arm coupled to the movable main contact; and a contact strap including an electrically conductive body portion having a plurality of discrete apertures arrayed in a pattern which define at least two input portions for splitting transient current input into the contact strap into generally parallel pathways which are in the same general direction as transient current flow in the movable contact arm; and an output portion electrically coupled to the input portions and the fixed stationary main contact, wherein the output portion is oriented so that transient current flow therethrough is in a general direction opposite to transient current flow in the movable arm.

9. The circuit breaker of claim 8, wherein the array of discrete apertures comprise at least one hole.

10. The circuit breaker of claim 8, wherein the array of discrete apertures comprise a plurality of holes in a generally u-shaped array.

11. The circuit breaker of claim 11, wherein the holes are formed by punching the conductive body.

12. The circuit breaker of claim 8, wherein the array of discrete apertures comprise at least one elongated hole.

13. The circuit breaker of claim 8, wherein the array of discrete apertures comprise a plurality of elongated holes in a generally u-shaped array.

14. The circuit breaker of claim 8, wherein the array of discrete apertures comprise grooves.

15. A circuit breaker comprising:

a housing;

an operating mechanism in the housing;

at least one pair of separable, electrically conductive main contacts in the housing, including a fixed stationary main contact and a movable main contact;

an electrically conductive movable contact arm coupled to the movable main contact; and a contact strap including an electrically conductive body portion having a plurality of discrete apertures arrayed in a pattern which define at least two input portions for splitting transient current input into the contact strap into generally parallel pathways which are also in the same general direction as transient current flow in the movable contact arm; and an output portion electrically coupled to both the fixed stationary main contact and the input portions between and inboard thereof, so that transient current flow the output portion is in a general direction opposite to transient current flow in the movable arm.

16. The circuit breaker of claim 15, wherein the array of discrete apertures comprise at least one hole.

17. The circuit breaker of claim 15, wherein the array of discrete apertures comprise a plurality of holes in a generally u-shaped array.

18. The circuit breaker of claim 17, wherein the holes are formed by punching the conductive body.

19. The circuit breaker of claim 15, wherein the array of discrete apertures comprise at least one elongated hole.

20. The circuit breaker of claim 15, wherein the array of discrete apertures comprise a plurality of elongated holes in a generally u-shaped array.

* * * * *